US010801240B2

(12) United States Patent
McCoy et al.

(10) Patent No.: US 10,801,240 B2
(45) Date of Patent: Oct. 13, 2020

(54) FLUSH TO FLOOR SILL TRACK AND ASSEMBLY FOR SLIDING GLASS WINDOWS

(71) Applicant: Fleetwood Aluminum Products, Inc, Corona, CA (US)

(72) Inventors: Mark S. McCoy, North Tustin, CA (US); Kevin M. Nguyen, Eastvale, CA (US)

(73) Assignee: Fleetwood Aluminum Products, Inc., Corona, CA (US)

( * ) Notice: Subject to any disclaimer, the term of this patent is extended or adjusted under 35 U.S.C. 154(b) by 210 days.

(21) Appl. No.: 16/019,275

(22) Filed: Jun. 26, 2018

(65) Prior Publication Data

US 2019/0003227 A1 Jan. 3, 2019

Related U.S. Application Data

(60) Provisional application No. 62/527,991, filed on Jun. 30, 2017.

(51) Int. Cl.

| | |
|---|---|
| ***E05D 15/06*** | (2006.01) |
| ***E06B 3/46*** | (2006.01) |
| ***E06B 1/70*** | (2006.01) |
| ***E06B 7/14*** | (2006.01) |

(52) U.S. Cl.

CPC ..... *E05D 15/0686* (2013.01); *E06B 1/702* (2013.01); *E06B 3/4609* (2013.01); *E06B 3/4636* (2013.01); *E06B 7/14* (2013.01); *E05Y 2201/684* (2013.01); *E05Y 2900/132* (2013.01)

(58) Field of Classification Search

None

See application file for complete search history.

(56) References Cited

U.S. PATENT DOCUMENTS

| | | | | |
|---|---|---|---|---|
| 5,469,666 | A * | 11/1995 | Lewis, Jr. | E06B 1/70 49/467 |
| 2003/0177699 | A1* | 9/2003 | Fukuro | E06B 3/4609 49/408 |
| 2005/0235571 | A1* | 10/2005 | Ewing | E05C 7/06 49/410 |
| 2010/0192468 | A1* | 8/2010 | Chubb | E05D 15/0686 49/407 |

(Continued)

FOREIGN PATENT DOCUMENTS

| | | | | |
|---|---|---|---|---|
| WO | WO-0120115 | A1 * | 3/2001 | E06B 3/4609 |
| WO | WO-2018224502 | A1 * | 12/2018 | E06B 7/14 |

*Primary Examiner* — Marcus Menezes

(74) *Attorney, Agent, or Firm* — Vista IP Law Group LLP

(57) ABSTRACT

A sill track for sliding panels such as doors or windows in a door jamb or window jamb. The sill track mounts flush to the surrounding floors and has an integrated drainage system for preventing water from penetrating the sill track. The sill track comprises a base having walls to support flooring, a panel track for receiving a guide of a panel, such as wheels of a sliding glass door, and a weep channel wall forming a weep channel for draining water to below a top surface of the sill track. The walls of the base, the panel track and the weep channel wall are configured such that the flooring installed on the sill track, the panel track and the top of the weep channel wall are all flush with the surrounding flooring on the interior and exterior of the sill track.

20 Claims, 6 Drawing Sheets

(56) References Cited

U.S. PATENT DOCUMENTS

| | | | | |
|---|---|---|---|---|
| 2012/0297712 | A1* | 11/2012 | Lutzner | E06B 7/14<br>52/302.1 |
| 2015/0159428 | A1* | 6/2015 | Johnson | E06B 7/14<br>49/471 |
| 2017/0183896 | A1* | 6/2017 | Dastrup | E05D 15/0686 |

* cited by examiner

FLUSH TO FLOOR SILL TRACK AND ASSEMBLY FOR SLIDING GLASS WINDOWS

RELATED APPLICATION

This Application claims the benefit of U.S. provisional Application No. 62/527,991 filed on Jun. 30, 2017 in accordance with 35 U.S.C. Section 119(e), 120, and any other applicable laws. The aforementioned application is hereby incorporated by reference herein in their entirety.

BACKGROUND

The field of the invention generally relates to sliding doors and windows, and more particularly, to sill track and assembly which is flush to the surrounding floor and includes a sub-floor drainage system.

Sliding glass doors and windows, such as patio doors, and panoramic multiple sliding glass door systems, are typically mounted in a door frame using a sill track which extend on the floor across the width of the door opening. Prior sill track designs mount on the floor and rise above the surrounding floor. The sill track rises above the surrounding floor to provide a water barrier to prevent water, such as precipitation, from outside the sliding door to cross the sill track and enter into the interior of the sliding door. In other words, the sill track blocks water from crossing the sill track from the outside to the inside.

Referring to FIG. 6, an example of a prior sill track design is illustrated. As can be seen in FIG. 6, prior sill tracks 100 included a water barrier wall 102 located at the inward side of the sill track 100. The water barrier wall 102 extends above the height of the exterior flooring 104 to provide a water barrier. Accordingly, the sill track 102 is NOT flush with the interior flooring 104 and exterior flooring 106 surrounding the sill track 100. Furthermore, the door track 108 is positioned below the top of the water barrier wall 102 that there is an elevation/grade change between the door track 108 and the top of the water barrier wall 102, as well. In addition, prior sill tracks, such as the example sill track 100 illustrated in FIG. 6, did not include any drainage system to direct water away from the sill track. As a result, water, such as rain or irrigation run-off would simply accumulate on the sill track 100, and/or puddle on the outward side of the sill track.

SUMMARY

The present invention is directed to an innovative sill track assembly for sliding doors or windows (collectively, sliding panels) installed in a door or window frame having two opposing vertical side jambs on opposing sides of the door or window frame, a head jamb extending between the side jambs across the top of the door or window frame and a sill extending between the side jambs across the bottom of the door frame along the floor. While the sill track assembly of the present invention will now be described with respect to a sill track assembly for sliding doors, it is understood that the sill track assembly may also be used for windows or other sliding structures, and that the invention is not limited to sliding doors. Accordingly, the sliding doors, windows, or other sliding structures are referred to generally as sliding panels.

The sill track mounts flush with the surrounding flooring and flooring installed onto the sill track, including the flooring on the inside/interior of the sill track (i.e., the interior of the door opening in which the sill track is mounted) and the flooring on the outside/exterior of the sill track (i.e., the exterior of the door opening in which the sill track is mounted). Furthermore, the sill track assembly includes an integrated drainage system including a weep channel located on the inside of the door track upon which wheels of the door ride when a sliding glass door is installed on the sill track assembly and a drain path to direct water entering the weep channel to be disposed, such as to a gutter, sewer, storm drain, or the like. As used herein, the terms "inside," "interior," "outside" and "exterior" are referenced based on the side of the sill track assembly having the weep channel being located toward the "inside" or "interior" of the door opening and the other side of the sill track assembly being to the "outside" or "exterior" of the door opening. Similarly, the directional term "inward" means toward the interior of the door opening and the directional term "outward" means toward the exterior of the door opening. For example, describing that a first structure is located inward of a second structure means that the first structure is located further in the direction of the inside of the door opening. The "interior" side of the sill track is located toward the interior of the door opening and the "exterior" side of the sill track is located toward the exterior of the door opening, In one embodiment, the sill track assembly comprises an elongated, interior sill track (also referred to as a first sill track) having a longitudinal length along a longitudinal axis, wherein the longitudinal length and longitudinal axis are configured to extend across a door opening of a door frame. The interior sill track has an exterior wall which extends along the longitudinal length of the sill track. Each of the additional elements of the interior sill track extends along the longitudinal length of the sill track, except for certain optional cut-outs, described in more detail below. The exterior wall may have an interior sill track joint for joining the interior sill track to an exterior sill track (also referred to as a second sill track), side-by-side, as described below. The exterior wall extends vertically from a bottom of the sill track to a horizontal, first flooring wall at a first height above the bottom. The first height above the bottom of the sill track is below the top of the interior sill track. The top of the interior sill track is the highest most point on the interior sill track and is configured to be flush with a top surface of finished flooring installed adjacent the sill track assembly. The first height is below the top of the interior sill track by a distance approximately equal to the thickness of the flooring such that the top surface of flooring installed on the first flooring wall is flush with the top of the interior sill track. As used herein, the term "flush" means that a respective top of each of the referenced structures are at substantially the same height, such as within ⅛" elevation of each other. Hence, the sill track assembly allows wheeled devices to easily and smoothly roll over the sill track assembly, and the sill track assembly does not create a ledge which can present a tripping hazard.

The first flooring wall extends horizontally from the first exterior wall to a track support, and is configured to support a first portion of flooring installed on the interior sill track. The first flooring wall has a first end connected to the first flooring wall and a second end connected to the track support. The track support includes a pair of opposing vertical track support walls, an exterior support wall and an interior support wall, which extend from the bottom of the interior sill track to the top of the sill track. The door track support has a horizontal track base extending between the track support walls.

A door track configured to receive a guide of a sliding door is disposed on the horizontal track base between the track support walls. The guide helps retain the sliding door on the interior sill track. The guide may be one or more wheels on the bottom of a sliding door, or a groove disposed on the bottom of a sliding door, or a protrusion extending from the bottom of the sliding door, which is received by the door track to retain the sliding door on the interior sill track. The top of the door track is flush is configured to be flush with the top surface of finished flooring installed adjacent the sill track assembly (i.e., it is substantially the same vertical height as the top of the sill track walls). A second flooring wall extends horizontally from the interior support wall to a weep channel wall at the first height, and is configured to support a second portion of flooring installed on the sill track. The second flooring wall has a first end connected to the track support (e.g., the inward one of the track support walls) and a second end connected to the weep channel wall.

The weep channel wall is a vertical wall which extends upward from the second flooring wall to the top of the interior sill track. The weep channel wall is positioned outward of the inward most side of the interior sill track. For instance, a spacer wall extends horizontally to a location laterally inward of the weep channel wall such that there is a horizontal space between the inward end of the spacer wall and the weep channel wall. The spacer wall has an outward end connected to another structure of the interior sill track, such as to the second flooring wall, or to a vertical support wall connected to the second flooring wall, to the track support, or even to the weep channel wall. For example, the spacer wall may extend, directly or indirectly, from the second flooring wall. The inward end of the spacer wall is configured to bear against an interior side wall of a sillpan into which the interior sill track is installed in order to maintain space between the weep channel wall and an edge of flooring and/or the interior side wall of the sillpan which forms an opposing wall of a weep channel.

In another aspect of the invention, the sill track assembly includes a sillpan which receives the sill track. The sillpan is an elongated pan which extends the length of the sill track. The sillpan has a pan bottom, an exterior side wall which extends upward from the pan bottom along the longitudinal length of the sill track on the outward side of the sill track, an interior side wall which extends upward from the pan bottom along the longitudinal length of the sill track on the inward side of the sill track, and two opposing end walls at either end of the exterior side wall and interior side wall.

In still another aspect, the sill track assembly may include two or more sill tracks arranged side-by-side (i.e., each of the longitudinal lengths of the sill tracks are arranged side-by-side in parallel). For example, in order to cover a door frame opening having a width of two or more sliding doors combined, the sill track assembly includes an interior sill track and one or more exterior sill tracks. Typically, each sliding door is installed on a different sill track so that the doors may slide adjacent to each other. In this case, the total number of interior and exterior sill tracks equals the number of doors. It is understood that multiple sliding doors may also be installed on the same sill track, in which case the total number of interior and exterior sill tracks equals the number of doors minus the number of doors installed on a same sill track as another door.

When multiple sill tracks are utilized, typically only one of the sill tracks needs to have a weep channel to form a water barrier. Generally, the interior most sill track includes the weep channel, and therefore it is referred to as the "interior" sill track. The other sill tracks exterior to the interior sill track do not need a weep channel because a single weep channel usually forms a sufficient water barrier to prevent water from crossing the sill tracks from the outside to the inside. The interior sill track is as described above.

The one or more exterior sill tracks are substantially the same as the interior sill track, except they do not include the weep channel wall, but instead the second flooring wall of the exterior sill track extends to an inward most side of the exterior (i.e., second) sill track such that the second flooring wall joins with the first flooring wall of the interior (i.e., first) sill track. The inward side of the second flooring wall of the exterior sill track has a second sill track joint which connects to the first sill track joint of the first sill track. The exterior wall of the exterior sill track also has an outward sill track joint for joining the first exterior sill track to a second exterior sill track, side-by-side, by joining the inward sill track joint of the second exterior sill track to the inward sill track joint of the first exterior sill track. As many exterior sill tracks as required can be added in the same manner.

The sillpan is sized to receive the number of sill tracks to be used in the particular application. For example, if two (2) sill tracks are to be used in a sill track assembly, then the sillpan has a width to accommodate an interior sill track and an exterior sill track, joined side by side. If three (3) sill tracks are to be used in a sill track assembly, then the sillpan has a width to accommodate an interior sill track and two exterior sill tracks, joined side-by-side, respectively.

In another aspect, one or more cut-outs are provided spaced along the longitudinal length of the interior and exterior sill tracks. The cut-outs are transverse cut-outs of the walls of the sill tracks for a short length (e.g., an inch, or so) which allow water draining into the weep channel to drain down to the pan bottom. The water can then collect at the locations of the cut-outs and a drain is connected to the pan bottom to drain the water out of the sillpan. The drain is connected to an irrigation system to direct dispose of the water, such as to a gutter, sewer, landscaping, etc.

BRIEF DESCRIPTION OF THE DRAWINGS

The foregoing and other aspects of embodiments are described in further detail with reference to the accompanying drawings, wherein like reference numerals refer to like elements and the description for like elements shall be applicable for all described embodiments wherever relevant.

DETAILED DESCRIPTION

Figure 5:
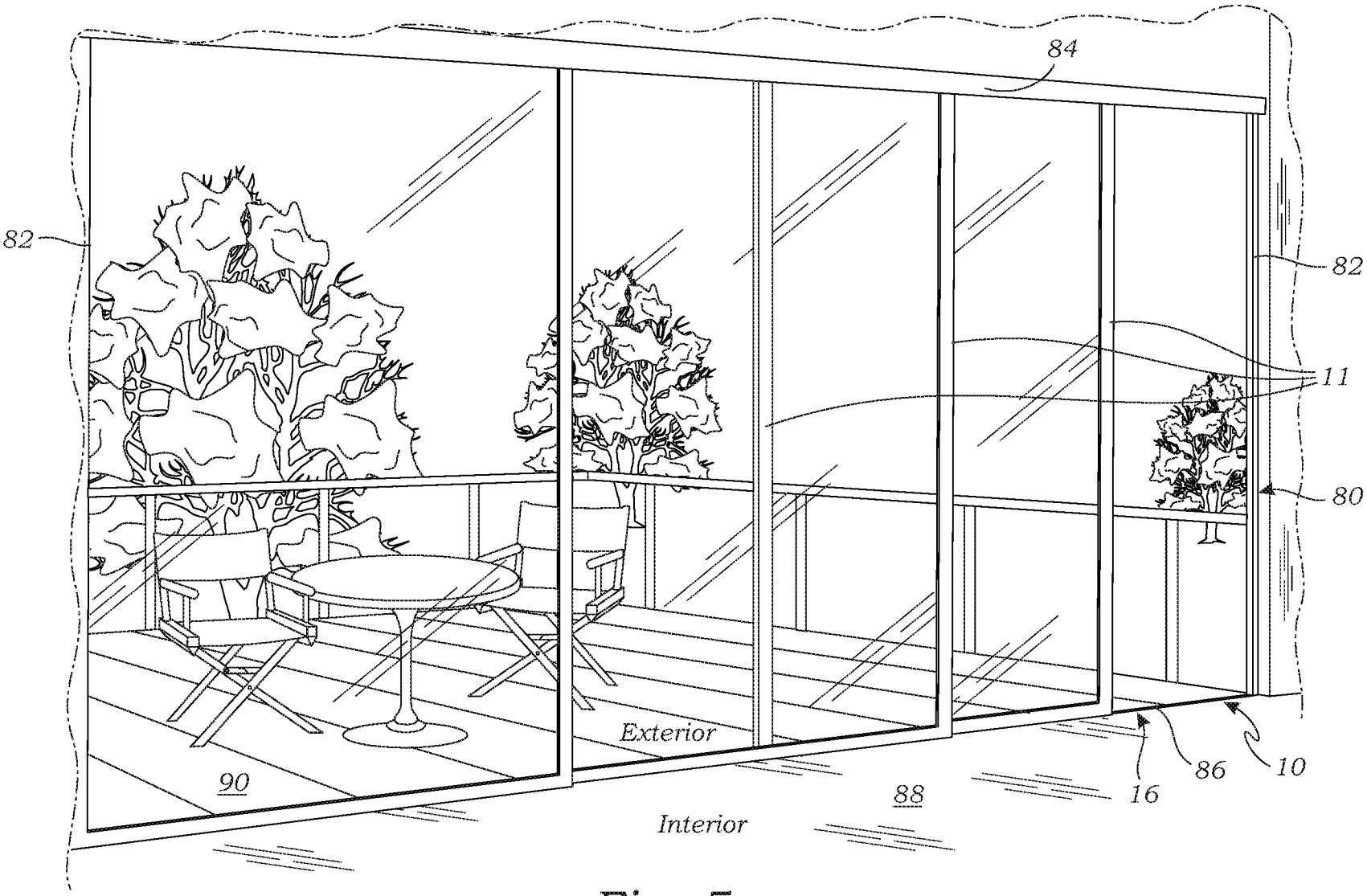
FIG. 5 is perspective view of a sill track assembly and multiple sliding glass doors installed on the sill track assembly according to one embodiment of the present invention.
Figure 6:
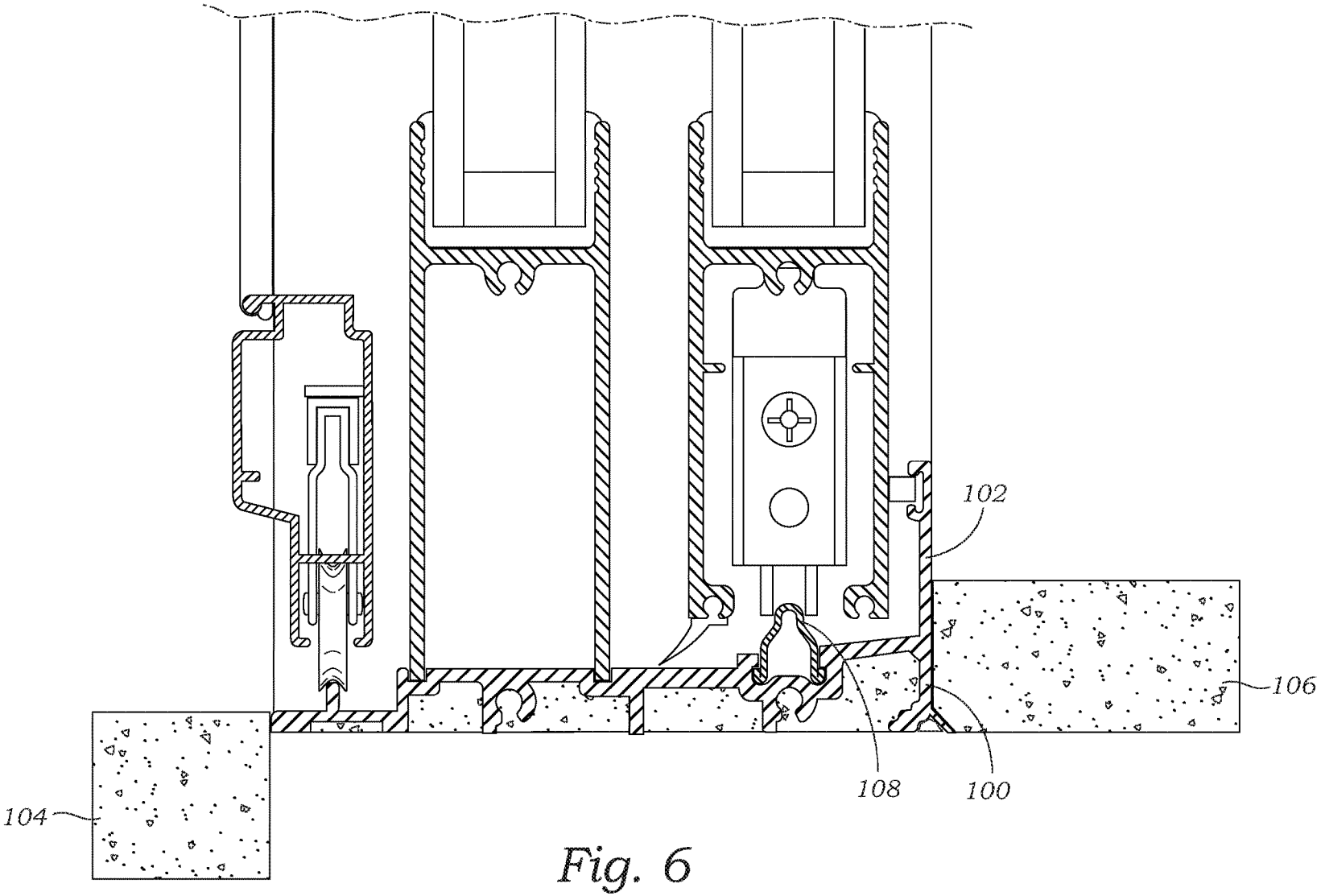
Fig. 6 (Prior Art)
FIG. 6 is a side, cross-sectional view of an exemplary prior art sill-track assembly.

Referring to FIG. 5, the present invention is directed to a sill track assembly 10 for supporting sliding glass doors 11 or windows (collectively, sliding panels) installed in a door frame 80 or window frame, as the case may be. The door frame 80 defines a door opening 16 in which the doors 11 are installed. Although the embodiments of the sill track assembly 10 are shown and described with respect to a sill track assembly for sliding doors, the present invention is not limited to a sill track assembly for sliding doors, but includes sill track assemblies for windows or other sliding structures and panels.

The door frame 80 has two opposing vertical side jambs 82 on opposing sides of the door frame 80, a head jamb 84 extending between the side jambs 82 across the top of the door frame 80 and a sill 86 extending between the side jambs 82 across the bottom of the door frame 80 along the floor. The sill track assembly 10 mounts flush with the surrounding flooring, including the interior flooring 88 on the inward side of the sill track assembly 10 (i.e., the interior of the door opening in which the sill track 10 is mounted) and the exterior flooring 90 on the outward of the sill track assembly 10 (i.e., the exterior of the door opening in which the sill track 10 is mounted). Furthermore, the sill track assembly 10 includes an integrated drainage system including a weep channel 58 located on the inward side of the door track upon which wheels of the sliding glass door 11 ride when a sliding glass door 11 is installed on the sill track assembly 10 and a drain path to direct water entering the weep channel 58 to be disposed, such as to a gutter, sewer, storm drain, or the like.

Figure 1:
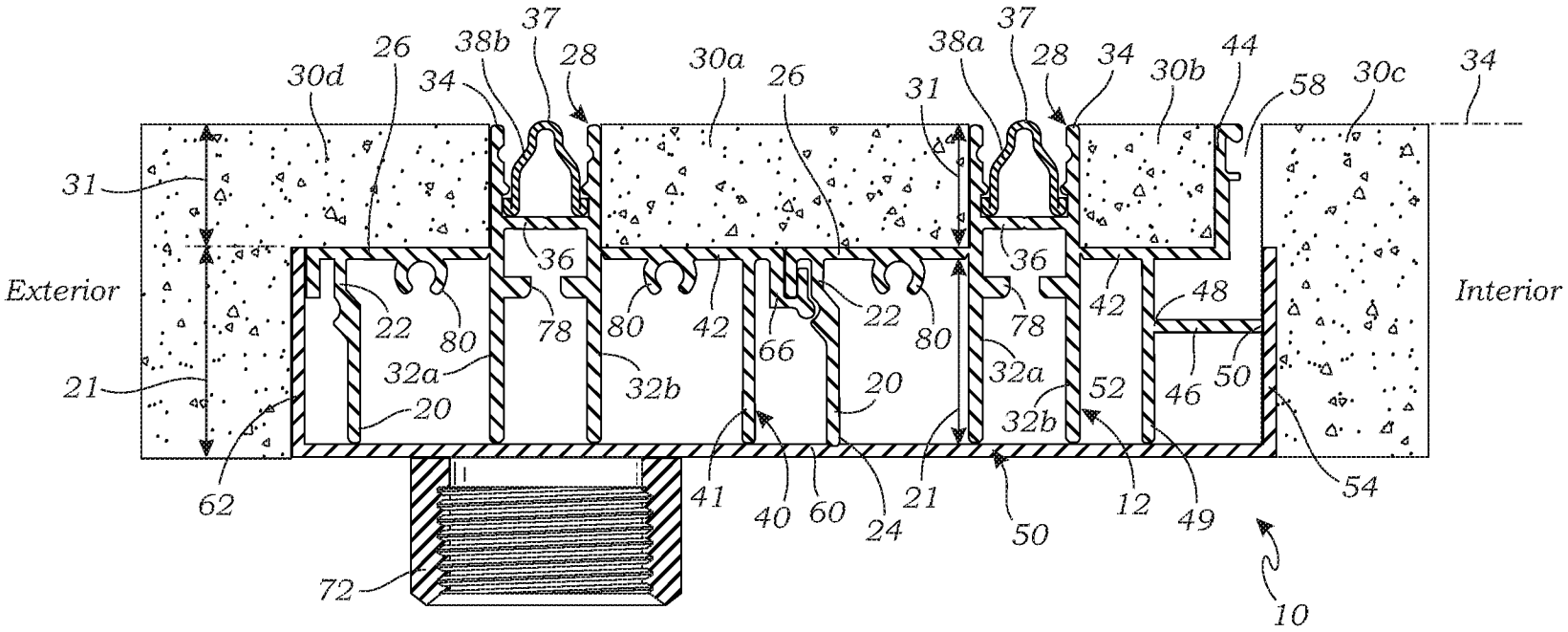
FIG. 1 is a side, cross-sectional view of a sill track assembly, according to one embodiment of the present invention.
Figure 2:
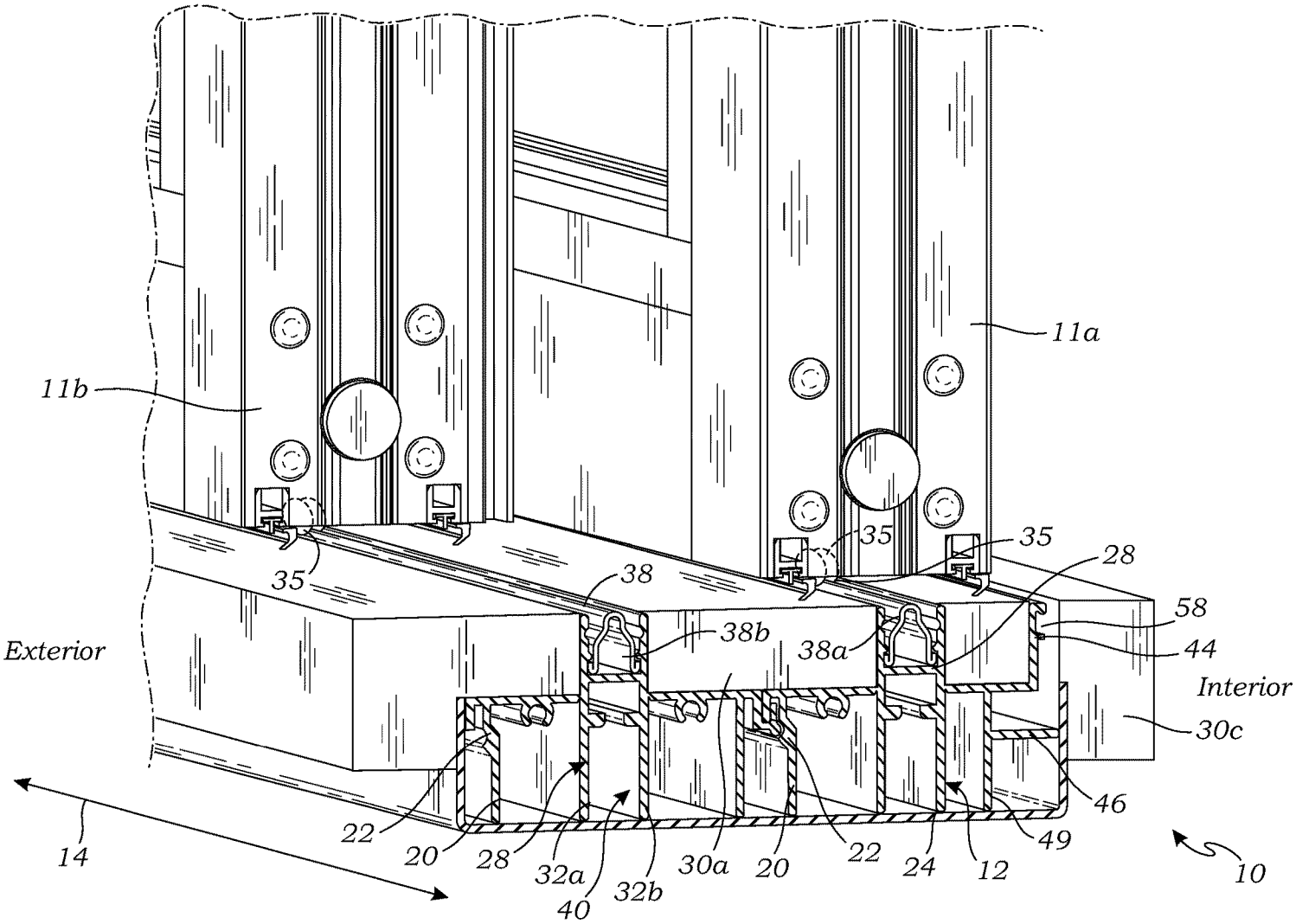
FIG. 2 is a perspective, cut-away view of a sill track assembly, having two sliding doors installed on the sill track assembly, according to one embodiment of the present invention.

Referring to FIGS. 1-2, in one embodiment, the sill track assembly 10 having two sill tracks is illustrated. The sill track assembly 10, as shown in FIGS. 1-2, is configured to support two sliding doors 11 (e.g., sliding doors 11*a* and 11*b* as shown in FIG. 2). The sill track assembly 10 comprises an interior sill track 12 which is configured to be installed inward of an exterior sill track 40, and an exterior sill track 40 configured to be installed on the outward side of the interior sill track 12. Although FIGS. 1-2 show a sill track assembly 10 having an interior sill track 12 and an exterior sill track 40, it is understood that the sill track assembly 10 may include just a single interior sill track 12.

The interior sill track 12 has a longitudinal length along a longitudinal axis 14, wherein the longitudinal length and longitudinal axis are configured to extend across the door opening 16 of the door frame 80. The interior sill track 12 has an exterior wall 20 at the outward extent of the interior sill track 12. The exterior wall 20 extends along the longitudinal length of the interior sill track 12. Each of the additional elements of the interior sill track 12 extends along the longitudinal length of the sill track 12, except for certain optional cut-outs, described in more detail below. The exterior wall 20 extends vertically upward from a bottom 24 of the sill track 12 to a first height 21 above the bottom 24, where it connects to a horizontal, first flooring wall 26. The interior sill track 12 has an outward (or first) sill track joint 22 for joining the interior sill track 12 to the exterior sill track 40, side-by-side. The outward sill track joint 22 is located outward of the exterior wall 20 and is connected to the exterior wall 20 and/or the first flooring wall 26. For instance, the outward sill track joint 22 may be a part of the exterior wall 20, and/or the first flooring wall 26.

The first flooring wall 26 extends horizontally at the first height 21 from the exterior wall 20 to a door track support 28. The first flooring wall 26 has an outward end (first end) connected to the exterior wall 20 and an inward end (second end) connected to the door track support 28 (more specifically, an outward support wall 32*a*). The first flooring wall 26 is configured to support a first portion of flooring 30*a* installed on the interior sill track 12. The first height 21 is below the top 34 of the interior sill track by a distance 31 approximately equal to the thickness 31 of the flooring 30 such that the top surface of the flooring 30*a* installed on the first flooring wall 26 is flush with the top 34 of the interior sill track 12.

The door track support 28 includes a pair of opposing vertical track support walls 32, an outward support wall 32*a* and an inward support wall 32*b*, which extend from the bottom of the interior sill track 12 to the top 34 of the sill track 12. The top 34 of the sill track 12 is configured to be flush with a top surface of finished flooring 30 installed onto and adjacent the sill track assembly 10. The door track support 28 has a horizontal track base 36 extending between the track support walls 32*a*, 32*b* at a height below the top 34 of the interior sill track 12.

A door track 38 is disposed on the track base 36 between the track support walls 32*a*, 32*b*. The door track is configured to receive a guide of the sliding glass doors 11, such as one or more wheels 35 disposed on the bottom of the sliding glass doors 11. The door track 38 has a track top 37 which is flush with the top 34 of the interior sill track 12.

A second flooring wall 42 extends horizontally at the first height 21 from the door track support 28 (more specifically, the inward track support wall 32*b*) to a weep channel wall 44. The second flooring wall 42 has an outward end (first end) connected to the inward track support wall 32*b* and an inward end (second end) connected to the weep channel wall 44. The second flooring wall 42 is configured to support a second portion of flooring 30*b* installed on the interior sill track 12. Like the first flooring wall 26, the second flooring wall 42 is at the first height 21 below the top 34 of the interior sill track by a distance 31 approximately equal to the thickness 31 of the flooring 30 such that the top surface of the flooring 30*b* installed on the second flooring wall 42 is flush with the top 34 of the interior sill track 12.

The weep channel wall 44 is a vertical wall which extends from the second flooring wall 42 to the top 34 of the interior sill track 12. The weep channel wall 44 is positioned outward of the inward most side of the interior sill track 12 such that there is a gap between the inward most side of the interior sill track 12 and the weep channel wall 44 thereby forming a weep channel 58 for draining water thereby preventing water from passing the interior sill track 12 to the sliding doors 11. The gap for the weep channel 58 is formed by a spacer wall 46 having an inward end 47 (second end) located laterally inward of the weep channel wall 44 such that there is a horizontal space between the inward end 47 and the weep channel wall 44. The spacer wall 46 has an outward end 48 which is connected to another structure of the interior sill track 12. In the embodiment shown in FIGS. 1-2, the outward end 48 is connected to a spacer support wall 49. The spacer support wall 49 is located outward of the weep channel wall 44 and extends vertically from the bottom 24 of the interior sill track 12 to the second flooring wall 42. The first end of the spacer support wall 49 is located at the bottom 24 of the interior sill track and the second end of the spacer support wall 49 is connected to the second flooring wall 42. Hence, the spacer wall 44 is indirectly connected to the second flooring wall 42 and therefore extends, indirectly, from the second flooring wall 42. Alternatively, the spacer wall 44 may be connected directly to the second flooring wall 42, or to the inward track support wall 34. The inward end 50 of the spacer wall 46 is configured to bear against an interior side wall 54 of a sillpan 56 into which the interior sill track 12 is installed in order to maintain space between the weep channel wall 44 and an edge of a third portion of flooring (also referred to as "interior flooring") 30*c* installed on the interior side of the interior sill track 12 and/or the interior side wall 54 of the sillpan 56 which forms an opposing wall of a weep channel 58.

As shown in FIGS. 1 and 2, the interior flooring 30*c* is installed on the inward side of the interior sill track 12 inward of the inward end 50 of the spacer wall 46. The outward edge of the interior flooring 30*c* also forms a part of the inward side of the weep channel 58. The top surface of the interior flooring 30*c* is also flush with the top 34 of the sill track assembly 10, as well as the first portion of flooring 30*a*, second portion of flooring 30*b* and interior flooring 30*c*. Accordingly, the sill track assembly 10 provides a sill track for mounting one or more sliding doors 11 which is flush with the surrounding flooring which maintains a substantially flat grade across the interior flooring 30*c* to the sill track assembly 10 to the exterior flooring 30*d*.

As mentioned above, the sill track assembly 10 includes a sillpan 56 which receives the interior sill track 12, as well as additional exterior sill tracks 40. The sillpan 56 is an elongated pan which extends the length of the sill tracks 12, 40. The sillpan 56 has a pan bottom 60, an exterior side wall 62 which extends upward from the pan bottom 60 along the longitudinal length of the sill tracks 12, 40 on the exterior side of the sill track 40, an interior side wall 54 which extends upward from the pan bottom 60 along the longitudinal length of the sill track on the interior side of the interior sill track 12, and two opposing end walls (not shown) at either end of the exterior side wall 62 and interior side wall 54.

In the embodiment shown in FIGS. 1 and 2, the sill track assembly 10 include two sill tracks 12, 40 arranged side-by-side (i.e., each of the longitudinal lengths of the sill tracks are arranged side-by-side in parallel). In the embodiment of FIGS. 1 and 2, the sill track assembly 10 includes an interior sill track 12, and an exterior sill track 40 joined together by joining the outward sill track joint 22 of the interior sill track 12 with a mating inward (or second) sill track joint 66 on the exterior sill track 40.

The exterior sill track 40 is substantially the same as the interior sill track 12, except that it does not have the weep channel wall 44, and it has sill joints 66 and 22 on both the inward side and outward side of the exterior sill track 40. Instead of a having a weep channel 44, the second flooring wall 42 of the exterior sill track 40 extends to an inward most side of the exterior sill track 40 such that the second flooring wall 42 of the exterior sill track 40 joins with the first flooring wall 26 of the first sill track 12. The second flooring wall 42 of the exterior sill track 40 and the first flooring wall 26 of the interior sill track 12 form a support for receiving the first portion of flooring 30*a*. The inward sill track joint 66 of the exterior sill track 40 is inward of the interior wall 41 and is connected to the interior wall 41 and/or second flooring wall 42 which connects to the outward sill track joint 22 of the interior sill track 12, or an outward sill track joint 22 of another exterior sill track joint 40. The exterior sill track 40 may also have an interior wall 41 at the inward extent of the exterior sill track 40. The interior wall 41 is a vertical wall which extends from the bottom 24 of the exterior sill track 40 upward to the first height 21 where it connects to the second flooring wall 42. For instance, the inward sill track joint 66 may be a part of the interior wall 41 and/or the second flooring wall 42.

Figure 3:
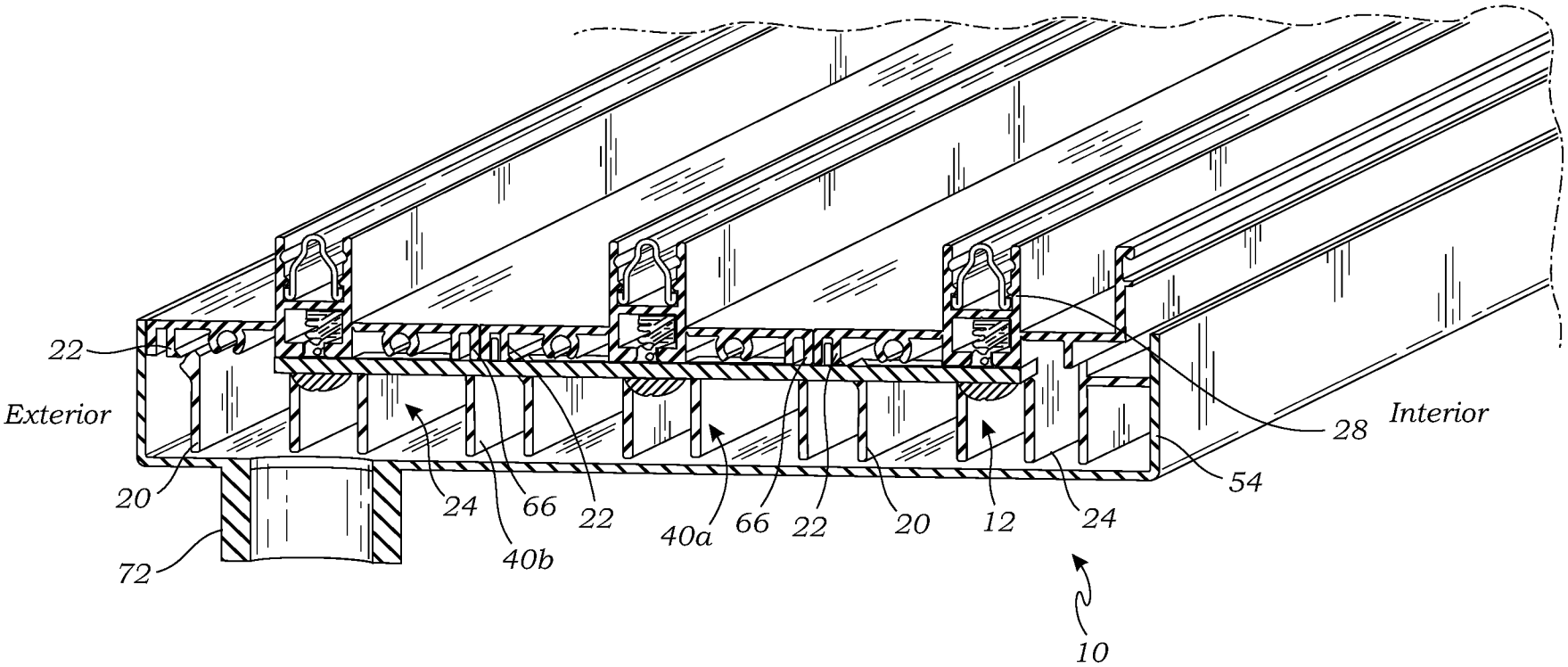
FIG. 3 is side, perspective, cut-away view of sill track assembly having three sill tracks and showing a cut-away and strap connection, according to one embodiment of the present invention.
Figure 4:
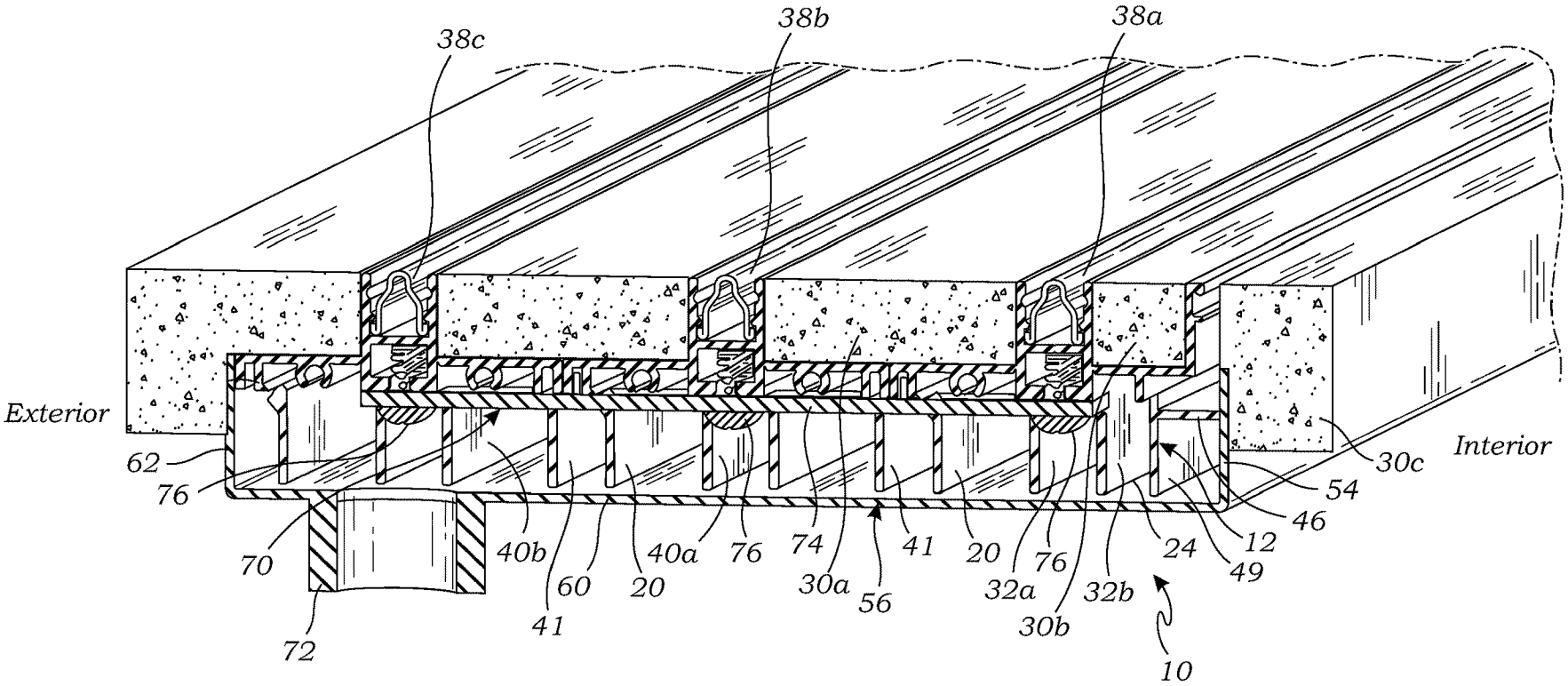
FIG. 4 is a side, perspective, cut-away view of sill track assembly as shown in FIG. 3, with flooring installed on the sill track assembly, according to one embodiment of the present invention.

The sill track assembly 10 illustrated in FIGS. 3 and 4 includes three sill tracks, 12, 40*a* and 40*b*. Specifically, the sill track assembly 10 of FIGS. 3 and 4 has one interior sill track 12, and two exterior sill tracks 40. A first exterior sill track 40*a* connects side-by-side to the interior sill track 12 as described above for an assembly 10 having two sill tracks 12, 40, and a second exterior sill track 40*b* connects side-by-side to the first exterior sill track 40*a* by joining the inward sill track joint 66 of the second sill track 40*b* to the outward sill track joint 22 of the first exterior sill track joint 40*a*.

By adding additional exterior sill tracks 40, any desired number of sill tracks 12, 40 may be joined in order to accommodate the desired number of sliding doors 11 for the particular installation.

The sillpan 56 is sized to receive the number of sill tracks 12, 40 to be used in the particular application. For example, if 2 sill tracks are to be used in a sill track assembly 10, then the sillpan 56 has a width to accommodate an interior sill track 12 and an exterior sill track 40, joined side by side. If 3 sill tracks 12, 40 are to be used in a sill track assembly 10, then the sillpan 56 has a width to accommodate an interior sill track 12 and two exterior sill tracks 40*a*, 40*b*, joined side-by-side, respectively.

Turning to FIG. 4, one or more cut-outs 70 are provided spaced along the longitudinal length of the interior and exterior sill tracks 12, 40. The cut-outs 70 are transverse cut-outs of the walls of the sill tracks 12, 40 for a short length (e.g., an inch, or so) which allow water draining into the weep channel 58 to drain down to the pan bottom 60. A tie strap or tie bar 74 extending transverse to the longitudinal length of the sill tracks 12, 40 is connected to the sill tracks 12, 40*a*, 40*b*, for example by bolting the tie-bar 74 to each of the sill tracks 12, 40*a*, 40*b* using bolts 76. The sill tracks 12, 40*a*, 40*b* have bolt slots 78 (see FIG. 1) into which the bolts 78 thread. The water can then collect at the locations of the cut-outs and a drain 72 is connected to the pan bottom 60 to drain the water out of the sillpan 56. The drain 72 is connected to an irrigation system to direct dispose of the water, such as to a gutter, sewer, landscaping, etc.

The sill tracks 12, 40 may also include screw raceways 80 (see FIG. 1), for receiving screws in order to secure the sill tracks 12, 40 to the side jambs of the door jamb and/or to connect end-to-end lengths of sill tracks 12, 40.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. The invention, therefore, should not be limited, except to the following claims, and their equivalents.

What is claimed is:

1. A sill track for mounting a sliding panel, wherein the sill track is flush with a surrounding flooring on both the interior of the sill track and exterior of the sill track, the sill track comprising:

an exterior wall extending along a longitudinal length of the sill track, the exterior wall extending vertically from a bottom of the sill track to a first height above the bottom of the sill track which is below a top of the sill track, wherein the top of the sill track is the highest most point on the sill track;

a first flooring wall extending along the longitudinal length of the sill track, the first flooring wall extending horizontally at the first height and having a first end connected to the exterior wall and a second end attached to a track support;

the track support extending along the longitudinal length of the sill track, the track support including a pair of opposing vertical track support walls and a horizontal track base, the vertical track support walls extending from the bottom of the sill track to the top of the sill track, the track base extending horizontally between the vertical track support walls at a height below the top of the sill track;

a panel track disposed on the track base and extending along the longitudinal length of the sill track, the panel track configured to receive a guide of a sliding panel for allowing the sliding panel to move along the panel track, the panel track having a track top which is flush with the top of the sill track;

a second flooring wall extending along the longitudinal length of the sill track, the second flooring wall extending horizontally at the first height and having a first end connected to the track support and a second end connected to a weep channel wall;

the weep channel wall extending along the longitudinal length of the sill track, the weep channel wall extending vertically from the second flooring wall to the top of the sill track; and a spacer wall extending along the longitudinal length of the sill track, the spacer wall extending horizontally at a height below the first height and having a first end connected to the sill track and a second end located interior of the weep channel wall.

2. The sill track of claim 1, wherein the exterior wall has a first sill track joint for joining the sill track to a second sill track side-by-side such the longitudinal length of the sill track is parallel and spaced apart from a longitudinal length of the second sill track.

3. The sill track of claim 1, wherein the guide is selected from the group consisting of one or more wheels mounted of a sliding door, a groove disposed on the bottom of a sliding door, and a protrusion disposed on the bottom of a sliding door.

4. The sill track of claim 1, wherein the sill track is configured to be installed in a door jamb.

5. The sill track of claim 1, wherein the sill track is configured to be installed in a window jamb.

6. The sill track of claim 1, wherein the sill track is configured such that the first height is below the top of the sill track by approximately a thickness of a flooring.

7. The sill track of claim 1, wherein the first end of the spacer wall is indirectly connected to the second flooring wall.

8. A sill track assembly for supporting a plurality of sliding panels, wherein the sill track assembly is flush with a surrounding flooring on both the interior of the sill track assembly and exterior of the sill track assembly, the sill track assembly comprising:

an interior sill track for supporting a first sliding panel, the interior sill track comprising:

a first exterior wall extending along a longitudinal length of the interior sill track, the exterior wall extending vertically from a bottom of the interior sill track to a first height which is below a top of the interior sill track, wherein the top of the interior sill track is the highest most point on the interior sill track, the first exterior wall having an interior sill track joint for joining the interior sill track to an exterior sill track side-by-side such that the longitudinal length of the interior sill track is parallel and spaced apart from a longitudinal length of the exterior sill track;

a first flooring wall extending along the longitudinal length of the interior sill track, the first flooring wall extending horizontally at the first height and having a first end connected to the first exterior wall and a second end attached to a first track support, wherein the first height is below the top of the sill track by approximately the thickness of an exterior flooring to be installed on the first flooring wall;

the first track support extending along the longitudinal length of the interior sill track, the first track support including a pair of opposing vertical track support walls and a horizontal track base, the vertical track support walls extending from the bottom of the interior sill track to a top of the interior sill track, the track base extending horizontally between the track support walls at a height below the top of the interior sill track;

a first panel track disposed on the horizontal track base and extending along the longitudinal length of the sill track, the first panel track configured to receive a first guide of a first sliding panel, the first panel track having a track top which is flush with the top of the interior sill track;

a second flooring wall extending along the longitudinal length of the sill track, the second flooring wall extending horizontally at the first height and having a first end connected to the track support and a second end connected to a weep channel wall;

the weep channel wall extending along the longitudinal length of the sill track, the weep channel wall extending vertically from the second flooring wall to the top of the sill track; and a spacer wall extending along the longitudinal length of the interior sill track, the spacer wall extending horizontally at a height below the first height and having a first end connected to the second flooring wall and a second end located inward of the weep channel wall;

an exterior sill track for supporting a second sliding panel, the exterior sill track comprising:

a second exterior wall extending along a longitudinal length of the exterior sill track, the second exterior wall extending vertically from a bottom of the exterior sill track to the first height which is below a top of the exterior sill track, wherein the top of the exterior sill track is the highest most point on the exterior sill track and the top of the exterior sill track is at substantially the same height as the top of the interior sill track;

a first flooring wall of the exterior sill track extending along the longitudinal length of the exterior sill track, the first flooring wall of the exterior sill track extending horizontally at the first height and having a first end connected to the second exterior wall and a second end attached to a second track support;

the second track support extending along the longitudinal length of the exterior sill track, the second track support including a pair of opposing vertical track support walls and a horizontal track base, the vertical track support walls of the second track support extending from the bottom of the exterior sill track to a top of the exterior sill track, the track base extending horizontally between the vertical track support walls at a height below the top of the sill track;

a second panel track disposed on the track base of the second track support and extending along the longitudinal length of the exterior sill track, the second panel track configured to receive a second guide of a second sliding panel, the second panel track having a track top which is flush with the top of the exterior sill track;

a second flooring wall of the exterior sill track extending along the longitudinal length of the exterior sill track, the second flooring wall of the exterior sill track extending horizontally at the first height and having a first end connected to the second track support and a second end connected to an interior wall;

the interior wall extending along the longitudinal length of the exterior sill track, the interior wall extending vertically from the second flooring wall of the exterior sill track to the bottom of the exterior sill track, the interior wall having an exterior sill track joint for joining the exterior sill track to the interior sill track side-by-side such that the longitudinal length of the interior sill track is parallel and adjacent to the longitudinal length of the exterior sill track.

9. The sill track assembly of claim 8, wherein the first guide and second guide are each selected from the group consisting of one or more wheels mounted on a sliding door, a groove disposed on the bottom of a sliding door, and a protrusion disposed on the bottom of a sliding door.

10. The sill track assembly of claim 8, wherein the interior sill track and exterior sill track are configured to be installed in a door jamb.

11. The sill track of claim 8, wherein the interior sill track and exterior sill track are configured to be installed in a window jamb.

12. The sill track assembly of claim 8, wherein the interior sill track and exterior sill track are each configured such that the first height is below the top of the respective sill track by approximately a thickness of a flooring.

13. The sill track assembly of claim 8, wherein the first end of the spacer wall is indirectly connected to the second flooring wall.

14. The sill track assembly of claim 8, wherein the second exterior wall has an exterior sill track joint for joining the exterior sill track to another exterior sill track side-by-side.

15. A method of installing the sill track of claim 1, comprising:

mounting the sill track in a sill of a jamb;

installing a first portion of flooring on the first flooring wall such that a top surface of the first portion of flooring is flush with the top of the sill track; and installing a second portion of flooring on the second flooring wall such that a top surface of the second portion of flooring is flush with the top of the sill track.

16. The method of claim 15, wherein the guide is selected from the group consisting of one or more wheels mounted on a sliding panel, a groove disposed on the bottom of a sliding panel, and a protrusion disposed on the bottom of a sliding panel.

17. The method of claim 15, wherein the jamb is a door jamb.

18. The method of claim 15, wherein jamb is a window jamb.

19. The method of claim 15, further comprising:

installing an exterior sill track in the jamb adjacent to the sill track side-by-side such that the longitudinal length of the interior sill track is parallel and adjacent to a longitudinal length of the exterior sill track, the exterior sill track comprising:

a second exterior wall extending along a longitudinal length of the exterior sill track, the second exterior wall extending vertically from a bottom of the exterior sill track to the first height which is below a top of the exterior sill track, wherein the top of the exterior sill track is the highest most point on the exterior sill track and the top of the exterior sill track is at substantially the same height as the top of the sill track;

a third flooring wall extending along the longitudinal length of the exterior sill track, the third flooring wall extending horizontally at the first height and having a first end connected to the second exterior wall and a second end attached to a second track support;

the second track support extending along the longitudinal length of the exterior sill track, the second track support including a pair of opposing vertical track support walls and a horizontal track base, the vertical track support walls of the second track support extending from the bottom of the exterior sill track to a top of the exterior sill track, the second track base extending horizontally between the vertical track support walls at a height below the top of the sill track;

a second panel track disposed on the second track base and extending along the longitudinal length of the exterior sill track, the second panel track configured to receive a second guide of a second sliding panel, the second panel track having a track top which is flush with the top of the exterior sill track;

a fourth flooring wall extending along the longitudinal length of the exterior sill track, the fourth flooring wall extending horizontally at the first height and having a first end connected to the second track support and a second end connected to an interior wall;

the interior wall extending along the longitudinal length of the exterior sill track, the interior wall extending vertically from the fourth flooring wall to the bottom of the exterior sill track, the interior wall having an exterior sill track joint for joining the exterior sill track to the sill track side-by-side such that the longitudinal length of the sill track is parallel and adjacent to the longitudinal length of the exterior sill track; and installing a third portion of flooring on the fourth flooring wall such that a top surface of the third portion of flooring is flush with the top of the exterior sill track.

20. The method of claim 19, further comprising:

installing one or more additional exterior sill tracks in the jamb adjacent to each other side-by-side such that the longitudinal length of the each of the exterior sill tracks and the sill track are parallel and adjacent to a longitudinal length of the adjacent exterior sill track.

* * * * *